United States Patent [19]

Darian et al.

[11] Patent Number: 4,746,420

[45] Date of Patent: May 24, 1988

[54] PROCESS FOR UPGRADING DIESEL OILS

[75] Inventors: Saeed T. Darian, Amherst, Mass.; Sayed-Hamid Arabshahi, Fayetteville, Ark.

[73] Assignee: REI Technologies, Inc., Tex.

[21] Appl. No.: 832,197

[22] Filed: Feb. 24, 1986

[51] Int. Cl.[4] ..... C10G 17/02; C10G 21/00; C10G 27/04; C10G 27/14

[52] U.S. Cl. ..... 208/222; 208/15; 208/96; 208/223; 208/224; 208/236; 208/240; 208/254 R; 208/265; 208/266; 208/282; 208/289; 208/323; 208/326; 208/327; 208/330; 44/57; 44/72

[58] Field of Search ..... 208/221, 222, 223, 236, 208/238, 240, 311, 323, 326, 327, 330, 332, 254 R, 282, 15, 289, 266, 224, 96, 265; 44/57, 72

[56] References Cited

U.S. PATENT DOCUMENTS

| | | | |
|---|---|---|---|
| 2,333,817 | 11/1943 | Proell | 44/57 |
| 3,135,680 | 6/1964 | Fierce et al. | 208/236 |
| 3,164,546 | 1/1965 | Millikan et al. | 208/236 |
| 3,197,400 | 7/1965 | Fierce et al. | 208/236 |
| 3,294,677 | 12/1966 | Martin et al. | 208/223 |
| 3,309,309 | 3/1967 | Hess | 208/240 |
| 3,847,800 | 11/1974 | Guth et al. | 208/254 R |
| 4,209,385 | 6/1980 | Stover | 208/254 R |
| 4,280,818 | 7/1981 | Schulz et al. | 44/56 |
| 4,297,206 | 10/1981 | Scheibel | 208/236 |
| 4,485,007 | 11/1984 | Tam et al. | 208/221 |
| 4,549,883 | 10/1985 | Purcell et al. | 44/57 |
| 4,585,461 | 4/1986 | Gorman | 44/56 |
| 4,643,820 | 2/1987 | Zarrineghbal et al. | 208/222 |

*Primary Examiner*—Helen M. S. Sneed
*Assistant Examiner*—Anthony McFarlane
*Attorney, Agent, or Firm*—Sughrue, Mion, Zinn, Macpeak, and Seas

[57] ABSTRACT

A process for upgrading diesel oil comprising the steps of:

(1) reacting the diesel oil with a nitrogenous treating agent;

(2) contacting the diesel oil from step (1) above with (a) a primary solvent selected from the group consisting of organic solvents having a dipole moment of about 1.3 or greater and mixtures thereof, with the proviso that alkyl amines and alkanol amines are excluded, or a water mixture of the primary solvent comprising about 50% by weight or less water and;

(b) a cosolvent different from the primary solvent selected from the group consisting of an alcohol having 1 to 4 carbon atoms, an aldehyde having 1 or 2 carbon atoms, a ketone having 3 carbon atoms, a carboxylic acid having 1 or 2 carbon atoms and mixtures thereof, or a water mixture of the cosolvent comprising about 50% by weight or less water;

wherein the primary solvent and cosolvent are each immiscible with the diesel oil or are in combination immiscible with the diesel oil, and (3) separating the diesel oil from step (2) above from the primary solvent and from the cosolvent to recover upgraded diesel fuel.

99 Claims, 1 Drawing Sheet

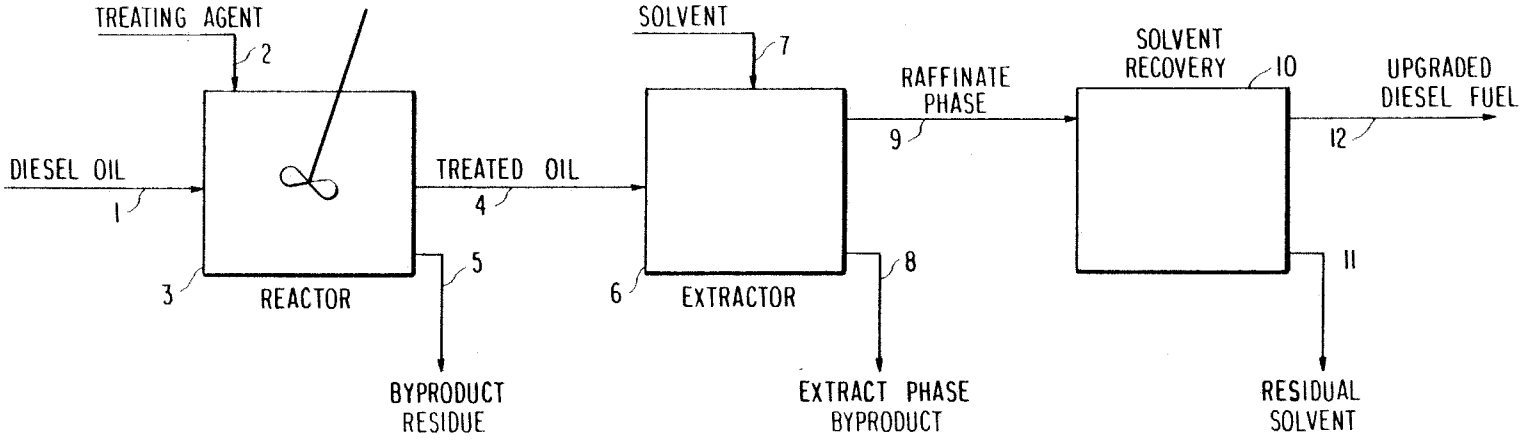
DIESEL OIL
1
TREATING AGENT
2
3
REACTOR
TREATED OIL
4
5
BYPRODUCT RESIDUE
SOLVENT
7
6
EXTRACTOR
8
EXTRACT PHASE BYPRODUCT
RAFFINATE PHASE
9
SOLVENT RECOVERY
10
11
RESIDUAL SOLVENT
12
UPGRADED DIESEL FUEL

PROCESS FOR UPGRADING DIESEL OILS

FIELD OF THE INVENTION

This invention relates to a process for upgrading the cetane rating of diesel oils. More particularly, the invention relates to a process for upgrading the cetane rating of diesel fuels while selectively removing instability-causing organic compounds from the oil. Specifically, this invention relates to a process for upgrading middle distillates containing such impurities by contacting the oils with nitrogen oxides or nitric acid under conditions enhancing removal of impurities by solvents in solvent extraction, solvent extracting the oil using a combination of selected solvents to remove the organic impurities, and then separating the oil from the solvents employed for extraction.

BACKGROUND OF THE INVENTION

Important properties of diesel fuels include ignition quality, oxidation stability, Ramsbottom carbon and sulfur content. Particularly with respect to ignition quality, cetane number is a limiting specification for diesel fuels. In order to be suitable for automotive use, No. 1 diesel fuel is generally made from virgin stocks having cetane numbers of about 45. Railroad diesel fuels are similar to automotive diesel fuels but can have somewhat lower cetane numbers of about 40.

Many uncracked or virgin paraffinic stocks such as straight run atmospheric gas oil have good compression ignition properties, i.e., a cetane number of about 45 or higher. In contrast, thermally or catalytically cracked stocks, such as cycle oils, have unsatisfactory ignition properties, i.e., cetane numbers below about 35.

In the past, in most countries of the world, sufficient quantities of diesel fuel were obtained as a stable, virgin product from crude oil distillation. However, higher crude prices and poorer quality crude oils have increasingly become an economic reality in refining processes. This has significantly changed the properties of distillate fuels and diesel fuels, especially in the United States. As heavier crudes are being used, bottom products are no longer in demand, and streams from various heavy oil cracking processes have increasingly been used as supplemental blending components for middle distillate fuels. Cracked products generally have poorer qualities as fuels (unless hydrocracked) than straight-run products of equivalent boiling range. With respect to diesel fuels, blending with cracked products has resulted in declining cetane numbers, increasing aromaticity and stability problems in the distillate pool.

The changes discussed above have resulted in a steady decline of cetane number over the past decade. These factors have also led to a loss of distillate fuel stability, which in turn has created problems with diesel fuel handling and performance characteristics. Instability of middle distillates is a result of complex reactions which are not completely understood, but is believed to be the result of three separate reactions: (1) acid-base reactions in which an organic acid and basic nitrogen react to form a sediment (acid-base salt); (2) oxidative gum reactions in which alkenes and oxygen react to form gum and (3) esterification reactions, in which aromatic hydrocarbons, heterocyclic nitrogens and benzothiols combined in a multistep process to form sediment.

Higher levels of unsaturates have resulted from increased use of fluid catalytic cracking units, as well as from blending of streams from thermal processes to meet market demands. The shift to heavier feedstocks and to higher severity operations is significant since, for example, a major change in FCC use could increase the availability of light cycle oil, which is a poor diesel fuel feedstock. The recent emphasis on bottom-of-the-barrel conversion is also expected to increase both nitrogen and sulfur compounds, as well as to produce additional distillate products not well suited for diesel fuel blending.

With an increase in the demand for middle distillates, diesel fuel quality is expected to erode further due to poorer quality of crude oils, a lower demand for bottom products and the increasing use of heavy oil cracking processes.

Recently, treatment to improve distillate quality and stability has been concentrated in three areas: hydrotreating, caustic scrubbing and chemical additives. Although hydro-treating is effective in desulfurization and in improving stability, it is a costly method of improving cetane and stability, requiring a high capital investment, use of hydrogen which is expensive and a high utilities cost relative to other treatment methods.

In refining petroleum distillates the removal of sulfur-containing compounds is also often required to meet product specifications. In the past various methods have been used to remove unwanted sulfur compounds, both by chemical treatment and by hydrodesulfurization. With increasing reliance on high-sulfur crude oil feedstocks, and the desire to divert hydrogen for other uses in the refining process than diesel hydrodesulfurization, chemical desulfurization methods are of increased interest.

The prior approaches involving high temperature, high pressure hydrodesulfurization to reduce the sulfur content of hydrocarbonaceous oils involve a number of major disadvantages. As indicated above, the high temperature, high pressure requirements make these processes quite expensive. The hydrogen required in the processes is expensive and requires water for its production. Further processing of the byproducts produced, such as hydrogen sulfide, which is highly toxic, and ammonia also contribute to the expense of the hydrodesulfurization process. Additionally, the catalyst used is often poisoned by materials contained in the hydrocarbonaceous oil, contributing to a further expense in the process. All of these factors result in economic disadvantage for the known processes.

Strong caustic scrubbing is often employed to remove sediment precursors such as benzenethiol, mercaptan sulfur, $H_2S$, acids and phenols from middle distillates. Although caustic scrubbing is often effective, it cannot produce a stable product in all cases, and cannot, for example, remove pyrrolic nitrogen impurities. The disadvantages of caustic treating include cost of maintaining caustic strength, disposal of spent caustic and loss of product by extraction.

Many types of chemical additives are currently used to improve middle distillate fuel quality, alone or in combination with other treatment techniques. Stabilizers generally provide basicity without initially entering into an organic acid-base reaction to form a salt. Antioxidants perform the same function with thermally derived distillates as they do for gasolines. Unsaturates provide free radical precursors that can enter into any of several sediment forming reactions, but these reactions are interrupted by the presence of an antioxidant.

Once sediment starts to form, however, stabilizers are less effective and dispersant type additives are used, which cause disassociation of agglomerated sediment particles as well as preventing agglomeration.

Because of the current economic requirement of cutting deeper into the barrel, and the desirability of blending uncracked with catalytically cracked stocks to produce diesel fuels, alternative methods of upgrading diesel fuel to meet the above specifications are now particularly important.

In the petroleum industry, solvent extractions have often been used to remove sulfur and/or nitrogen compounds from petroleum distillates and synfuels, the extract oil and solvent then being separated by distillation. In general, however, solvent extraction of petroleum products to remove sulfur involves a large loss of oil yield and high solvent-to-oil ratio, and provides only limited sulfur removal.

A method of increasing cetane number has long been sought in the art, and it is generally known that the cetane characteristics of a fuel composition containing both aromatic and paraffinic constituents can be improved by removing the aromatic component to increase the concentration of paraffins, e.g., by solvent extraction. However, because aromatics are present in large concentrations, this approach results in uneconomic yield losses when significant improvements in cetane and stability are to be achieved. Further, because of the need to remove large amounts of aromatics and olefins, uneconomically high solvent-to-oil ratios are necessary to provide the requisite solvation capacity. Thus, extraction is not used commercially for these purposes.

It has also long been known that the cetane number of diesel fuels can be improved either by adding a nitrogen-containing fuel additive, or by oxidation with a nitrogenous oxidizing agent. Fuel oils in the diesel range having the proper physical characteristics such as pour point, cloud point, viscosity and volatility can be obtained by nitrogenating the diesel fraction in order to increase the cetane number. However, it is well known that the nitrogenation of such fuel oils tends to increase the Ramsbottom carbon content and to decrease the stability of the oils with formation of an insoluble sediment, which produces a haze and eventually a deposit while the fuel oils are in storage. While many attempts to eliminate the disadvantage of poor stability characteristics have been made and solvent extraction, including caustic scrubbing, has been applied for stability improvement, conventional solvent extraction has proven insufficient to provide sufficient stability in the case of nitrogen-treated fuels at high yields, with sulfur removal, and without cetane loss.

The invention described and claimed herein is directed to a process for upgrading a diesel oil by increasing the cetane rating and reducing Ramsbottom carbon and instability-causing compounds using a nitrogenation/extraction/separation approach in contrast to the generally used catalytic hydrogenation. caustic scrubbing and chemical additive approaches conventionally practiced.

Although various processes for treating petroleum fractions by oxidation or extraction are known, such methods have generally not been satisfactory for upgrading a substandard diesel oil fuel stock by increasing cetane number and improving stability and Ramsbottom carbon of the resulting fuel, with simultaneous sulfur removal if necessary.

Selective solvent extraction to remove aromatic components of petroleum distillates is well known.

U.S. Pat. No. 3,317,423 discloses preparation of a carbon black feedstock by aromatic extraction of a heavy (500° F.+) hydrocarbon using a dual solvent of furfural and a paraffinic hydrocarbon. Preparation of an aromatic carbon black feedstock in a two-stage solvent extraction process using furfural, phenol, liquid sulfur dioxide or glycol ethers is disclosed in U.S. Pat. No. 3,349,028, in which Ramsbottom carbon is also extracted. U.S. Pat. No. 3,415,743 discloses the extraction of heavy aromatics and heavy aliphatics from cycle oil in a two-stage process using dimethyl formamide (5 to 18% water) and xylene in the first stage.

U.S. Pat. No. 3,546,108 discloses a furfural/dimethyl formamide/water mixed solvent used for the extraction of aromatics from gas oils and U.S. Pat. No. 2,137,206 also relates to a method for dewaxing oils using furfural, alone or in combination with auxiliary solvents, such as benzol, benzol and toluol or light petroleum hydrocarbons.

A process for separating petroleum into paraffinic and naphthenic fractions using a mixed solvent including an alkyl-substituted formamide and an alcohol such as methanol or ethylene glycol is disclosed in U.S. Pat. No. 2,183,852. Refining of lubricating oil stock to produce high viscosity index lubricating oil by solvent extraction is disclosed in U.S. Pat. No. 2,067,137, in which acetyl mono- and di- methyl and ethyl amines and corresponding compounds derived from formamide are used as a primary solvent, optionally in combination with a modifying solvent such as benzol, naphtha, propane or butane.

In U.S. Pat. No. 3,169,998 the selective separation of aromatic hydrocarbons from olefinic hydrocarbons, and the extraction of olefinic hydrocarbons from mixtures of olefinic and saturated hydrocarbons is disclosed using liquid gamma-butyrolactone as a solvent. Auxiliary solvents can optionally be used, including sulfur dioxide, sulfolanes, nitriles, ethers, certain glycols, tetrahydrofuran, halogenated hydrocarbon solvents, dimethyl formamide, ketones and aldehydes including furfural. This patent however contains no teaching regarding the importance of prenitrogenation, or of the improvement in cetane and stability which is possible by a combined nitrogenation and cosolvent extraction of diesel oil. Amine sulfonate solvents for extraction of aromatic feedstocks are disclosed in U.S. Pat. No. 2,522,618.

U.S. Pat. No. 3,539,504 describes production of a middle distillate fuel such as kerosene having improved burning and color characteristics by a temperature graduated furfural extraction to remove aromatics and olefins. Auxiliary solvents can optionally be used, including water, sulfolanes, nitriles, ethers, glycols, tetrahydrafuran, halogenated hydrocarbon solvents, dimethyl formamide, ketones, crotonaldehyde, butyrolactone and butyrolactam. There is no disclosure or appreciation of a prenitrogenation step or of its importance in obtaining a diesel fuel having improved cetane and stability when combined with an extraction step using cosolvents.

These patents relating to solvent extraction or solvent/cosolvent extraction all fail to appreciate the importance of nitrogen treatment prior to solvent extraction, and the surprising yield enhancement obtained thereby, or the control of other important product properties, such as stability and Ramsbottom carbon, obtained by the combined use of nitrogen treatment and extraction with selected solvents in the present invention.

Processes for treating petroleum stock by oxidation followed by solvent extraction have been described for various purposes. For example, oxidation/extraction processes of hydrocarbonaceous oils to produce sulfoxides and sulfones are disclosed in U.S. Pat. No. 2,825,744, British Pat. No. 442,524, U.S. Pat. No. 2,702,824, and U.S. Pat. No. 2,925,442.

Further, U.S. Pat. Nos. 3,847,800 and 3,919,402 describe the use of nitrogen oxides followed by extraction by methanol to remove both sulfur and nitrogen compounds from petroleum stocks.

U.S. Pat. No. 4,485,007 discloses a process for purifying hydrocarbonaceous oils containing both heteroatom sulfur and heteroatom nitrogen compound impurities, such as shale oils, by first reacting the hydrocarbonaceous oil with an oxidizing gas containing nitrogen oxides while limiting the molar ratio of the nitrogen oxide to the total sulfur heteroatom content and nitrogen heteroatom content and limiting the conversion of sulfur heteroatom content into gaseous sulfur oxides to about 60% or less on a weight basis, followed by extracting the oxidized oil in one step with an amine selected from the group consisting of ethylene diamine, monoethanolamine, diethanolamine and mixtures thereof, and a second extracting step using formic acid as an extracting solvent. It is disclosed that the amine extracting solvent acts to remove sulfur compound impurities and the formic acid extracting solvent acts to remove nitrogen impurities.

A process for producing a fuel composition by oxidizing a hydrocarbon oil with aqueous nitric acid, followed by extraction with acetone, methyl ethyl ketone, cyclohexanone, methanol, ethanol, normal propanol, isopropanol, ethyl acetate, tetrahydrofuran, dioxane, or a combination of an alcohol and a ketone, an alcohol and water, a ketone and water or a combination of alcohols is disclosed in U.S. Pat. No. 4,280,818.

Although the methods described above have met with some success in desulfurizing petroleum fuels, the known approaches toward oxidation to remove a portion of the original sulfur content as gaseous sulfur oxides, and to convert a portion of the original sulfur content into sulfoxides and/or sulfones followed by extraction with appropriate solvents to achieve a desired low sulfur raffinate have not completely eliminated problems.

Similarly, direct extraction of hydrocarbonaceous oils with selected solvents to remove sulfur and nitrogen impurities to produce a raffinate which is low in sulfur content results in uneconomically low yields of the desired raffinate, along with reductions in the sulfur content of the hydrocarbonaceous oil. The methods described above basically have the disadvantages that (a) the solvents selected are suitable only for specific select oils; (b) the solvents result in poor extraction yields or they do not provide sufficient phase separation to make solvent extraction possible; (c) unacceptably high solvent-to-oil ratios are required, decreasing oil yield and making the processes uneconomical; (d) they require expensive catalyst or extremely severe oxidizing conditions to provide sufficient sulfur removal; or (e) oxidation desulfurization methods involving nitrogenous oxidizing agents often result in increased gum and sedimentation, and reduce the stability of the fuels produced.

For these reasons, the present technology for sulfur removal involving oxidation and subsequent extraction of hydrocarbonaceous oils require improvement.

Similarly, conventional methods of improving diesel cetane number by treatment with nitrogenous oxidizing agents are inadequate to meet other product specifications. Particularly, diesel fuels produced by nitrogenous oxidation and solvent extraction can in some cases meet sulfur and cetane requirements for fuels, but are unsatisfactory with respect to the important specifications of stability and Ramsbottom carbon content. Processes employing sulfuric acid in conjunction with nitrogenous oxidizing agents are ineffective to retain a high cetane rating. Distillative methods are commercially unfeasible due to the presence of substantial carbonaceous deposits in the still, and when thermal treating is applied to diesel fuel to reduce the sulfur content of the residue, this process also produces substantial carbonaceous deposits in the thermal treating still.

Apart from the failure of conventional oxidative cetane enhancement methods to provide diesel fuels of sufficient stability and Ramsbottom carbon content, these methods, like the oxidative desulfurization methods, employ solvents which result in poor yields, requiring unacceptably high solvent-to-oil ratios. Alternatively, the solvents used in some prior methods reduce or entirely eliminate the advantage of cetane enhancement obtained by oxidation.

Particularly, because of the variety of sulfur-containing compounds and instability-causing compounds present in petroleum hydrocarbon feedstocks, and because of the selectivity of solvents for particular sulfur-containing compounds, nitrogen-containing compounds, aromatic compounds and olefinic compounds, previous attempts to upgrade middle distillate fuels by oxidation, solvent extraction or a combination of the two have concentrated on at most one or two product characteristics, and have generally required sacrificing product yield and stability in order to achieve products of acceptable sulfur content or ignition properties.

Although many diesel fuels having low cetane ratings and high sulfur content meet stability and Ramsbottom carbon specifications, if these fuels are oxidized to improve cetane rating or reduce sulfur, Ramsbottom carbon and stability become unacceptable.

Because of these significant disadvantages, conventional oxidation/extraction methods for upgrading middle distillates have largely been supplanted by hydrotreatment, or by chemical additive treatments for improving stability and cetane.

Copending U.S. patent application Ser. No. 832,612, filed Feb. 24, 1986, relates to a method of improving diesel cetane and desulfurization, while retaining acceptable stability and Ramsbottom carbon content, by first contacting a diesel oil with a nitrogenous treating agent and then extracting the treated oil with a selected polar solvent, including furfural, butyrolactone, dimethyl formamide, dimethyl acetamide, methyl carbitol, tetrahydrofurfuryl alcohol, aniline, dimethyl sulfoxide, sulfolane, ethylene chlorohydrin and acetic anhydride. While effective in upgrading a diesel oil and increasing cetane, while retaining acceptable stability and Ramsbottom carbon content, this process is still not completely effective in eliminating the undesirable deterioration in stability caused by nitrogenation.

SUMMARY OF THE INVENTION

One object of the present invention is a process for improving the cetane number of diesel oil without producing unacceptable stability or Ramsbottom carbon content.

Another object of the present invention is a process for upgrading diesel oil employing solvent extraction with a high solvent extraction efficiency and correspondingly high yield.

An additional object of the present invention is a process for producing a blended diesel fuel from off-specification diesel oils meeting industrial specifications for cetane, sulfur content, Ramsbottom carbon, product stability and/or pour point.

It has now been discovered that a diesel oil can be improved, and the production of stable diesel fuels from substandard or blended stocks remarkably simplified, by a simple and economical process of first contacting the distillate oil with a nitrogenous treating agent such as gaseous nitrogen oxides, nitrous acid or nitric acid, followed by selective solvent extraction using a combination of a selected solvent and a selected cosolvent. The process according to the invention permits the simultaneous desulfurization and cetane improvement of diesel fuels and unexpectedly with remarkably improved stability on storage and enhanced handling characteristics.

Accordingly, in one embodiment, the present invention provides a process for upgrading diesel oil comprising the steps of:

(1) reacting the diesel oil with a nitrogenous treating agent;

(2) contacting the diesel oil from step (1) above with (a) a primary solvent selected from the group consisting of organic solvents having a dipole moment of about 1.3 or greater and mixtures thereof, with the proviso that alkyl amines and alkanol amines are excluded, or a water mixture of the primary solvent comprising about 50% by weight or less water and;

(b) a cosolvent different from the primary solvent selected from the group consisting of an alcohol having 1 to 4 carbon atoms, an aldehyde having 1 or 2 carbon atoms, a ketone having 3 carbon atoms, a carboxylic acid having 1 or 2 carbon atoms and mixtures thereof, or a water mixture of the cosolvent comprising about 50% by weight or less water;

wherein the primary solvent and the cosolvent are each immiscible with the diesel oil or are in combination immiscible with the diesel oil, and (3) separating the diesel oil from step (2) above from the primary solvent and from the cosolvent to recover upgraded diesel fuel.

In another preferred embodiment of this invention, this invention provides a process for upgrading diesel oil comprising the steps of (1) reacting the diesel oil with a nitrogenous treating agent;

(2) contacting the diesel oil from step (1) above with (a) a primary solvent selected from the group consisting of organic solvents having a dipole moment of about 1.3 or greater and containing at least one of the following functional groups:

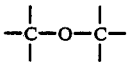

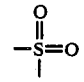

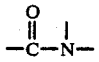

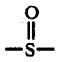

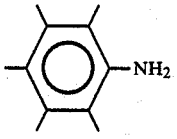

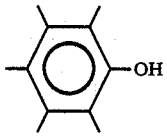

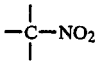

and

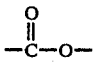

and mixtures thereof or a water mixture of the primary solvent comprising about 50% by weight or less water; and (b) a cosolvent different from the primary solvent selected from the group consisting of an alcohol having 1 to 4 carbon atoms, an aldehyde having 1 or 2 carbon atoms, a ketone having 3 carbon atoms, a carboxylic acid having 1 or 2 carbon atoms, and mixtures thereof, or a water mixture of the cosolvent comprising about 50% by weight or less water;

wherein the primary solvent and the cosolvent are each immiscible with the diesel oil or are in combination immiscible with the diesel oil, and (3) separating the diesel oil from step (2) above from the primary solvent and from the cosolvent to recover upgraded diesel fuel.

In an even further embodiment of this invention, this invention provides a process for upgrading diesel oil comprising the steps of:

(1) reacting the diesel oil with a nitrogenous treating agent;

(2) contacting the diesel oil from step (1) above with (a) a primary solvent selected from the group consisting of furfural, butyrolactone, dimethyl formamide, dimethyl acetamide, methyl carbitol, tetrahydrofurfuryl alcohol, aniline, dimethyl sulfoxide, sulfolane, ethylene chlorohydrin, acetic anhydride, phenol, nitromethane, N-methylpyrrolidone, sulfolene, methanol, acetonitrile, ethyl cyanoacetate, acetic acid and mixtures thereof, or a water mixture of the primary solvent comprising about 50% by weight or less water, and (b) a cosolvent different from the primary solvent selected from the group consisting of an alcohol having 1 to 4 carbon atoms, an aldehyde having 1 or 2 carbon atoms, a ketone having 3 carbon atoms, a carboxylic acid having 1 or 2 carbon atoms, and mixtures thereof, or a water mixture of the cosolvent comprising about 50% by weight or less water;

wherein the primary solvent and the cosolvent are each immiscible with the diesel oil or are in combination immiscible with the diesel oil, and (3) separating the diesel oil from step (2) above from the primary solvent and from the cosolvent to recover upgraded diesel fuel.

BRIEF DESCRIPTION OF THE ACCOMPANYING DRAWING

The FIGURE is a schematic flow diagram of one embodiment of the process of this invention.

DETAILED DESCRIPTION OF THE INVENTION

As indicated above, this invention provides a process for upgrading diesel fuel oils, including those containing heteroatom sulfur compounds, to produce a diesel fuel with improved cetane number while meeting stability requirements. The process of this invention is applicable to the upgrading of diesel oil which can be derived from any source, for example, a convention petroleum crude oil or crude oil fraction containing sulfur, aromatic, olefinic and naphthenic compounds as impurities. The term "diesel oil" as used herein is broadly defined to include any hydrocarbon having a nominal boiling range of about 350° F. to 650° F. which can be upgraded by the process of this invention to meet commercial specifications for a diesel fuel and the term "diesel fuel" is generally used to describe the upgraded product, although the terms can be used interchangeably. The diesel oil to be treated with the nitrogenous treating agent and extracted preferably contains less than 50% aromatics, although the product obtained in the process of this invention can be blended with diesel fuel of any aromatic content.

The process of this invention is basically not limited in terms of the source of the diesel oil, but is applicable to any diesel oil from petroleum, coal, shale, tar sands, etc.

In the process for upgrading diesel oils according to the invention, particular product specifications may vary over a range. The present process may be readily applied and modified by one skilled in the art to produce diesel fuel having particular desired specifications, particularly with respect to the basic criteria of cetane, stability, Ramsbottom carbon and sulfur content discussed above.

Fuel stability is measured by a number of accelerated tests, one of which is the Nalco 300° F. test. For satisfactory stability in commercial storage and use, a transportation fuel must exhibit a Nalco rating of about 7.0 or lower. A rating of about 7.0 is the upper level of acceptability for commercial use, although a lower limit is desirable. The applicable Nalco test is well known in the art, and the test can be simply performed, for exampled, by placing 50 ml of oil to be tested in a tube 3 cm in diameter, heating the tube in a 300° bath for 90 minutes, and then cooling the oil. The oil is then filtered using a micropore filter with a number 1 filter paper, the filter and the filter paper are washed with heptane, and the residue remaining is compared with standard samples to determine the stability rating. If a fuel has a Nalco rating slightly exceeding 7, it may often be blended with other stocks or treated with economic levels of chemical additives to bring it into specification.

Desulfurization is a second generally important aspect of purification or upgrading of hydrocarbonaceous oils. Sulfur compounds present as impurities may include, for example, thiophenic sulfur, mercaptan sulfur, sulfides, thiols and disulfides. Because of the differing selectivities of various solvents in extracting different sulfur-containing impurity compounds, which can be enhanced or depressed by nitrogenation, depending on the particular solvent and feed characteristics, selection of an appropriate solvent for desulfurization is empirical and selection generally is not possible on the basis of theory.

Although cetane number is an important quality characteristic of diesel fuels, cetane enhancement obtained by nitrogenation is poorly understood. In particular, although it is known that increasing nitrogen content in the treated oil causes increased cetane and it is known that aromatics extraction contributes to cetane improvement, raffinate nitrogen is not well correlated with cetane improvement, and aromatics removal alone cannot account for the cetane response obtained.

In addition to management of the above criteria of stability, sulfur content and cetane number, Ramsbottom carbon content is an important quality specification for diesel fuels, since fuels high in Ramsbottom carbon cause fouling problems when used in diesel engines. In an acceptable diesel fuel, the Ramsbottom carbon content is preferably less than about 0.3 weight percent, as determined by the method disclosed in ASTM D 524, prior to addition of any nitrate additives for cetane improvement.

While not desiring to be bound by theory, it is currently believed that the complex process according to the present invention for upgrading diesel oils by contact with a nitrogenous treating agent and extraction probably involves nitrogen addition to paraffins, olefins, naphthenes and aromatics to form nitrates, esters, amines, azides, indoles and the like. The choice of an appropriate extracting solvent with a high selectivity for the compounds formed after this treatment permits selective removal of cetane-neutral or cetane-depressing compounds in extraction. In addition, sulfur-containing and instability-causing compounds can be simultaneously extracted by the choice of an appropriate solvent. The choice of an appropriate solvent is critical, and is made difficult by the circumstance that solvents which are capable of extracting some of the above-mentioned components will nonetheless be ineffective for use in the present invention because they will (a) not remove appreciable sulfur; (b) remove so much nitrogen to improve stability that an undesirably low cetane results; (c) not remove nitrogen, resulting in acceptable cetane but unacceptable stability; or (d) result in poor yield. Typically, the process of this invention can be employed on an atmospheric gas oil fraction derived from liquid petroleum crude sources. Atmospheric gas oil is one component used in diesel oil blending, and may contain an off-specification sulfur content for use as a diesel fuel. Typically, sulfur as a heteroatom is present as thiols, disulfides, sulfides, thiophenes, and mercaptans, and nitrogen is present as substituted pyridines and pyrroles, and other compounds. A typical analysis of atmospheric gas oils is set forth in Table 1 below.

TABLE 1

| Properties of Atmospheric Gas Oil (AGO) | | |
|---|---|---|
| | Stock X | Stock CC |
| Gravity, API | 34.0 | 37.6 |
| Sulfur, wt. % | 1.07 | 0.72 |
| Nitrogen, ppm | 200 | 150 |
| Cetane Number | 58 | 53 |
| D86 Distillation, °F. | | |
| start | 216 | 300 |
| 5% | 418 | 408 |
| 10% | 482 | 446 |
| 30% | 532 | 501 |
| 50% | 558 | 529 |
| 70% | 584 | 562 |
| 90% | 618 | 619 |
| 95% | 636 | — |

As can be seen from an examination of the analysis presented in Table 1, the atmospheric gas oils, Stock X and Stock CC, have a high sulfur content. For these stocks, a satisfactory cetane number, Ramsbottom carbon content and stability are present. If cetane enhancement were attempted by the process according to this invention, improvements in the important commercial criteria of sulfur content and cetane number can be obtained while retaining satisfactory Ramsbottom carbon content and stability.

FIG. 1 describes schematically an embodiment of the process of this invention comprising mixing atmospheric gas oil feed 1 and nitric acid inlet 2 into a reactor 3. After reaction in the reactor, the treated oil 4 may be separated from a byproduct residue 5 and is passed into a solvent extractor 6, where it is contacted with a mixture of a primary solvent and cosolvent 7 for extraction and after solvent/treated oil separation to remove an extract phase containing solvent with impurities 8, the treated raffinate phase with residual solvents 9 is subjected to recovery at 10 to remove residual solvents 11 and to obtain upgraded diesel fuel 12. In an alternative embodiment not shown, the treated product can first be contacted with the primary solvent and subsequently contacted with the cosolvent solvent. Therefore, the feed can be contacted with the cosolvent either in admixture with the primary solvent, or a raffinate oil phase obtained after solvent extraction with the primary solvent and solvent/treated oil separation can be separately contacted with the cosolvent. The primary and cosolvents can be separated in one or more steps.

In yet another alternative, the cosolvent can be contacted first with the treated product, followed by contact with the primary solvent.

In the first step of the process of this invention, a diesel oil component such as an atmospheric gas oil fraction is reacted by contacting the oil with a nitrogenous treating agent. If desired, the feed oil can first be subjected to pretreatment, such as by washing to remove phenols or other corrosive components of the oil, filtering to remove gum or sediment, heating or treatment with $H_2SO_4$ as conventionally used. In the first step of the process of the invention, the treating agent is a nitrogenous treating agent. The term "nitrogenous treating agent" is used herein to mean any known nitrogen-containing oxidizing compound including, e.g., an oxidizing gas containing at least one nitrogen oxide with more than one oxygen atom for each nitrogen atom, a liquid containing at least one nitrogen oxide with more than one oxygen atom for each nitrogen atom, nitric acid and nitrous acid.

The treating gas used can be a gas containing only such a nitrogen oxide or can be one which contains mixtures of such nitrogen oxides. Furthermore, the treating gas can be one which also contains other components such as oxygen, nitrogen, lower nitrogen oxides, i.e., nitrogen oxides containing only one oxygen atom or less than one oxygen atom per nitrogen atom in the oxide. For efficiency, preferably the treating gas will be one which contains only nitrogen oxides with more than one oxygen atom for each nitrogen atom but mixtures with other gases such as oxygen, nitrogen, as well as inert gases such as air, helium and helium with air can be employed if desired. Suitably the treating gas will contain at least 0.5% by volume of at least one nitrogen oxide with more than one oxygen atom for each nitrogen atom, but the concentration can be reduced if the flow rate of treating agent is increased for a longer time. Nitrogen dioxide or its dimer $N_2O_4$ can be advantageously employed, alone or in a admixture with air.

The nitrogenous treating liquid used can be a liquid nitrogen oxide as defined above, nitric or nitrous acid either concentrated or in admixture with up to about 90% water by weight. Preferably the liquid nitrogenous treating agent is an aqueous solution of nitric acid containing about 50 to 90% by weight nitric acid.

When liquid nitric acid is used as a nitrogenous treating agent in the present invention, it may advantageously be used in combination with other organic or inorganic acids. Suitable inorganic acids include sulfuric and phosphoric acids, and suitable organic acids include, e.g., acetic and formic acids. The organic and inorganic acid may be used alone or in combination. Typically, an inorganic acid can be added to the aqueous nitric acid solution used as a treating agent in an amount of from about 5 to 200% by weight of the nitric acid solution, and an organic acid can be added in an amount from about 5 to 200% by weight of the nitric acid solution. Preferred combinations of nitric and auxiliary acids include nitric and sulfuric, nitric and acetic, and nitric and formic acids.

When liquid nitrous acid is used as a nitrogenous treating agent in the present invention, it may advantageously be used in combination with other organic or inorganic acids. Suitable inorganic acids include sulfuric and phosphoric acids, and suitable organic acids include, e.g., acetic and formic acids. The organic and inorganic acid may be used alone or in combination. Typically, an inorganic acid can be added to the aqueous nitrous acid solution used as a treating agent in an amount of from about 5 to 200% by weight of the nitrous acid solution, and an organic acid can be added in an amount from about 5 to 200% by weight of the nitrous acid solution. Preferred combinations of nitrous and auxiliary acids include nitrous and sulfuric, nitrous and acetic, and nitrous and formic acids. Mixtures of nitric acid and nitrous acid can also be used.

In the first step of the process of this invention, a diesel oil such as atmospheric gas oil is reacted with a nitrogenous treating agent in the form of a liquid or gas. The contacting of the diesel oil with the treating liquid can be accomplished by any means conventional in the art for contacting two liquid reactants, e.g., by injecting the acid mixture under the surface of agitated oil contained in a reactor. When a treating gas is employed, the treating gas can be contacted with the diesel oil using any conventional means for contacting a gaseous reactant with a liquid reactant. Suitable examples of such means for contacting a gaseous reactant with a liquid reactant include dispersing the gas as bubbles in the liquid, trickling the liquid over an inert solid bed with gas passing also over the bed concurrently or countercurrently to the liquid flow, the latter type flow being preferred.

It is important in the first step of the process of this invention to control the operating parameters during the reaction of the diesel oil with the treating gas or liquid to insure sufficient reaction to improve cetane and to improve the extraction efficiency in the second step of sulfur compound containing impurities and impurities contributing to instability. However, the reaction step should be limited so that detrimental effects on the diesel substrate ultimately obtained and recovered after the process for purification of this invention do not occur. These important processing controls as to the reaction of the diesel oil with the treating agent are described in more detail below.

As used herein, the term "acid-to-oil ratio" refers both to the weight of water-free acid to the weight of feedstock and to the weight of undiluted gaseous or liquid nitrogenous treating agent to the weight of feedstock, and is from about 0.0002 to 0.5, preferably from about 0.0005 to 0.1, for the acids and from 0.0001 to 0.5 and preferably 0.0003 to 0.06, for the nitrogen oxides. The control of the treatment may be achieved by controlling the water content of the acid in the reactor, by controlling the mixture of nitrogenous gas and air or inert gas used or by controlling temperature, time and degree of agitation. The treatment can also be controlled and improved by the copresence of sulfuric acid through its effect on water availability or other auxiliary acid mixed with the treating agent. This control of the weight ratio of nitrogenous treating agent to the total weight of the hydrocarbon feed can be easily maintained.

The reaction of the first step of the present invention can be performed at any temperature from about −40° to 200° C., but is preferably conducted at a temperature of about 100° C. or less, most preferably about 25° to 90° C. The reaction time is not particularly limited, and may include, for example, any time from about 1 minute to about 3 weeks. The first step of the present invention may be conducted at atmospheric pressure or at greater or lower pressures as desired. Advantageously, the reaction step is conducted using conventional agitation means, such as a stirrer.

Since a nitrogenous treating agent is used in the first step of the present invention, typically an increase in nitrogen compound content over that originally present in the diesel oil will be observed. While not desiring to be bound by theory, the reason for the increase is observed nitrogen compound content is believed to be that nitration and esterification of the diesel oil substrate can occur resulting in an increase in the hetero-atom nitrogen compound content.

Because of the complexity of the reactions involved, the treating agents may well do more than oxidize or nitrate compounds contained in the diesel oil in the process according to the invention. Hence, the first step is variously described herein as "nitrogenation" of simply "nitrogen treatment" or more simply "treatment", which refers to any reaction of the nitrogenous treating agent and diesel oil or its components, without limitation, and without reliance on any particular reaction or reaction mechanism.

Contact times on the order of less than about 120 minutes and weight ratios of nitrogenous treating agent to total feed of less than about 0.1 are desirable not only from the standpoint of efficiency but also from the standpoint of economics. Particularly preferably, a contact time of about 30 minutes in combination with a weight ratio of nitrogenous treating agent to diesel oil of about 0.03 or less can be advantageously employed with maximum yield of diesel oil with reduced sulfur content and improved stability.

However, because of the known relationship of nitrogenous treating agent to cetane number, it is often advantageous when using a nitrogenous treating agent to carefully control the minimum amount of nitrogen compounds added to the diesel feed in order to insure a sufficient cetane number in the diesel fuel produced.

In the process of the invention, in order to improve Ramsbottom carbon and stability while retaining high cetane, a preferred level of nitrogen in the oil following the first step of contacting the oil with a nitrogenous treating agent is from about 500 to 6,000 ppm of nitrogen.

A diesel oil, after being subjected to the reaction described above for step (1) of the process of this invention, is then subjected to an extraction step (2) with a primary extracting solvent and a cosolvent, either in combination or sequentially. As will be seen from the examples to be given hereinafter, processing conditions set forth for the nitrogenation step (1) above are controlled to improve the ability of the specific and selected extracting solvents used in the extracting step (2) of the process of this invention to enhance removal by extraction of sulfur-containing impurities, instability-causing compounds, Ramsbottom carbon, cetane-depressing compounds and aromatic compounds present originally in the diesel oil feed, and thereby to reduce their level in the ultimate oil recovered and purified as a result of the process of this invention.

The extraction step (2) of the process of this invention, the diesel oil obtained from step (1) of the process of this invention is contacted with a least one primary extracting solvent and at least one cosolvent different from the primary extracting solvent, the solvents being used either in combination or in any sequence. Either solvent may be used as a water mixture containing about 50% by weight or less water.

Primary solvents useful in the extraction step (2) of the present invention include those having a dipole moment of about 1.3 or greater with the exception that alkyl amines and alkanol amines are not employed as a primary solvent. Suitable solvents more particularly include those containing one of the following functional groups:

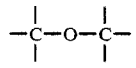

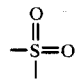

-continued

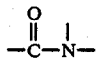

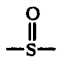

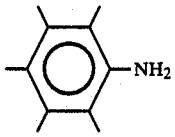

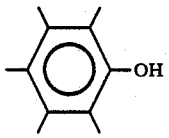

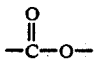

and

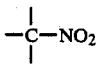

Specific examples of suitable primary solvents include furfural, butyrolactone, dimethyl formamide, dimethyl acetamide, methyl carbitol, tetrahydrofurfuryl alcohol, aniline, dimethyl sulfoxide, sulfolane, ethylene chlorohydrin, acetic anhydride, phenol, nitromethane, N-methylpyrolidone, sulfolane, methanol, acetonitrile, ethyl cyanoacetate and acetic acid. These extracting solvents are used in combination with a second oil-immiscible cosolvent different from the primary solvent and selected from an aldehyde, having 1 or 2 carbon atoms (such as formaldehyde and acetaldehyde), a ketone having 3 carbon atoms, an alcohol having 1 to 4 carbon atoms (such as methanol, ethanol, (n-or iso-)-propanol and (n-, iso-or sec-)-butanol) and a carboxylic acid having 1 or 2 carbon atoms such as formic acid and acetic acid. Combinations of more than one primary solvent or of more than one cosolvent can also be used without any restrictions on order of use. Alkyl amines and alcohol amines are not considered solvents due to their reactivity with treating agents.

According to the present invention it has now been discovered that the stability of such hydrocarbon distillate fuels can be significantly increased by performing the extraction step of the present invention using a primary solvent as described above in combination with a cosolvent selected from the group consisting of an aldehyde, ketone, alcohol, or carboxylic acid as described above, or by extracting with such a primary solvent and sequentially extracting with the cosolvent in any order.

In particular, cosolvent alcohols, ketones, and aldehydes are useful in the cosolvent extraction of the present invention. Specific examples of cosolvent alcohols which may be used in the present invention are methanol, and when immiscible either alone or in mixture of primary solvent in a particular treated diesel feedstock, ethanol, propanol and butanol. Methanol is particularly preferred. Suitable cosolvent aldehydes are formaldehyde and acetaldehyde, preferably acetaldehyde. For ketones, acetone can be used.

Lower carboxylic acids which are useful cosolvents in the present invention include formic and acetic acids. Acetic acid is preferred.

These aldehydes, ketones, alcohols and carboxylic acids may be used alone or in a combination of two or more thereof.

When an alcohol, ketone or aldehyde cosolvent is used in admixture with a primary solvent in the extraction step of the present invention, it typically constitutes from about 0.01 to 5.0 weight ratio based on the total oil feed, more preferably from about 0.1 to 0.5 weight ratio based on the total oil feed used.

When an alcohol, ketone or aldehyde cosolvent is used sequentially after a primary solvent in the extraction step of the present invention, it typically constitutes from about 0.01 to 5.0 weight ratio based on the total oil feed, more preferably from about 0.1 to 0.5 weight ratio based on the total oil feed used.

When a carboxylic acid cosolvent is used in combination with a primary solvent in the extraction step of the present invention, it typically constitutes from about 0.01 to 5.0 weight ratio based on the total oil feed, more preferably from about 0.1 to 0.5 weight ratio based on the total oil feed used.

Further, the primary solvent/cosolvent combination used can be either a mixture of these two solvent types or such can be used in admixture with water to the extent of about 50% by weight of water. Water in combination with these extracting solvents can be advantageously used to increase phase separation and yields of oil recovered. The amount of water which can be used with any combination of primary extracting solvent and cosolvent can be appropriately determined by running routine screening tests to determine for a particular diesel feedstock to be upgraded and under the reaction conditions employed in step (1), which of the extracting solvents, used alone or in admixture with water and to what extent in admixture with water can be advantageously used. These routine screening tests can be simply a consideration of yield, reduction in sulfur content present, stability and cetane number, determined by routine chemical analysis, to determine which of the extracting solvents or water/extracting solvents mixtures can be most advantageously used with a given treated diesel oil feed.

In the extracting step (2) of the present invention, conventional extraction procedures are employed. Generally, the primary solvent and cosolvent are simply added to and mixed with the diesel oil processed as in step (1). The time for contact with the extracting solvents is only that time necessary to permit a simple mass transfer of the sulfur compound impurities, instability-causing compound impurities, or Ramsbottom carbon containing components from the diesel oil phase into the extracting solvent phase, and is typically from about 1 to 30 minutes. Generally, a suitable extraction time, whether the extraction is sequential or in combination, ranges from about 1 to 10 minutes.

The temperature of the extracting step is controllable over wide ranges, and can be, for instance, any temperature from about 40° F. to 300° F. and preferably is at room temperature, e.g., about 70° to 90° F. The primary solvent and cosolvent used can be added in substantially pure form, e.g., as obtained from commercial sources, or can each be a used solvent which is recovered and purified or recycle stream rich solvent, with any deficiency in amount of solvent(s) desired for extraction being made up by the addition of additional pure solvent(s). Although the present invention is illustrated in the examples using a single solvent extraction step, the solvent extraction step (2) can be conducted, if desired, in a sequence of separate solvent extraction zones either countercurrently or cocurrently, varying, e.g., time, temperature, or solvent-to-oil ratio as desired. If desired the nitrogenated oil can first be contacted with the primary extracting solvent and subsequently contacted with the cosolvent under conditions as described above.

It should be recognized that in the extraction step (2) of the present invention, the primary solvent and cosolvent are either both substantially immiscible with the treated diesel oil or are immiscible when used in combination. The term "immiscibility" as used herein means that two distinct phases are formed permitting separation of solvent and oil phases at the temperature and solvent-to-oil ratio described herein. This characteristic thus permits an easy phase separation after the extraction is completed. Most of the primary solvents used in the present invention have a boiling point near that of the diesel oil, and for this reason are difficult to separate from the oil. If the treated oil is contacted sequentially with the primary solvent and cosolvent, recovery of the primary solvent is facilitated, since the cosolvent also removes the high-boiling primary solvent, simplifying solvent recovery from the raffinate.

If an emulsion is formed, it can be easily broken, e.g., by warming, for phase separation.

The extraction in step (2) of the process of this invention can be generally conducted by simply adding the primary solvent and cosolvent to the treated diesel oil, mixing such with the treated diesel oil, allowing phase separation of the solvent/diesel oil mixture to occur and then separating the extracting solvent phase containing the sulfur impurity content or instability-causing content removed from the treated diesel oil substrate phase. Conventional chemical engineering techniques can be employed to achieve this extraction conducted in step (2) of the process of this invention.

Generally, a suitable primary solvent-to-oil ratio by weight can range from about 0.01:1 to about 5:1, preferably 0.1:1 to 0.5:1, but these ratios are not considered to be limiting. A suitable cosolvent-to-oil ratio by weight can range from about 0.01:1 to about 5:1, preferably 0.1:1 to 0.5:1, but these ratios are not considered to be limiting.

As used herein the term "extracting solvent-to-oil ratio" or simply "solvent-to-oil ratio (S/O)" refers to the total primary solvent and cosolvent to diesel oil ratio. In a preferred embodiment of the present invention, the solvent-to-oil ratio in the solvent extraction step (2) is reduced to much smaller values than those conventionally used in order to increase the overall efficiency of the reaction/extraction process.

It is possible to improve the stability of a treated oil by either increasing solvent-to-oil ratio or by improving the extraction efficiency, such as by continuous countercurrent extraction. For example, it is shown herein that a stability of 12 is obtained with one primary solvent, butyrolactone, at a solvent-to-oil ratio of 0.5 and that a stability of 9 is obtained with a ratio of 1.0. A similar effect is achievable by increasing the solvent-to-oil ratio of the cosolvent. However, it is generally uneconomic to utilize increasing solvent-to-oil ratio to control product stability, particularly in view of the results achievable at low solvent-to-oil ratios with the cosolvents employed in the present invention. For example, using butyrolactone as a primary solvent and methanol as a cosolvent, a stability of 4 is obtained under similar conditions.

The severity of the reaction of step (1) may be measured either by (a) the reaction conditions employed or (b) the effects on the properties of the treated oil. In general, high reaction severity is achieved with an acid-to-oil ratio exceeding 0.02, temperatures exceeding about 70° C., contact times exceeding about 1 hour, and acid strength exceeding about 70% by weight, although many combinations can be employed. In general, a high severity has been employed if the product oil contains att least 2000 ppm nitrogen, has a cetane exceeding the feed oil by at least 7 numbers, has a sulfur removal exceeding 20%, has a Nalco stability exceeding about 15, or has a Ramsbottom carbon content exceeding about 4%, although these effects depend upon the diesel feedstock used.

In general, increasing severity produces desirable results in sulfur removal, cetane increase and yield. To also meet stability and Ramsbottom constraints, however, large primary solvent-to-oil ratios must be employed which are not advantageous, and thus this results in associated yield loss. The use of the cosolvent significantly improves yields and stability at a specific primary solvent-to-oil ratio.

With increased severity of reaction in the first step of the present invention, increased cetane and sulfur reduction are obtained, however, stability deteriorates and Ramsbottom carbon is undesirably increased. Extraction in the second step of the present invention further reduces sulfur content, while significantly improving stability and Ramsbottom carbon. The degree of stability and Ramsbottom carbon content improvement obtained is directly related to the solvent-to-oil ratios used in extraction. While it is generally possible to obtain suitable stability and Ramsbottom carbon content by using a sufficiently high solvent-to-oil ratio of a primary solvent as defined herein, using a high solvent-to-oil ratio is costly, and results in low yield and loss of cetane. By the present invention it is possible to obtain upgraded diesel fuel having acceptable stability and Ramsbottom carbon even at low solvent-to-oil ratios, at high yields and while retaining cetane increase.

Particularly according to the present invention, it has been discovered that conducting the extraction of the treated oil using both a primary solvent and a cosolvent results in a remarkable and unexpected increase in the stability of the diesel oil produced, in comparison with the extraction of a treated oil using a primary solvent alone.

Furthermore, the remarkably low solvent-to-oil ratios required for nitrogenated stocks are accompanied by increased oil yields. Accordingly, the process according to the present invention provides substantially improved yields with substantially lower solvent-to-oil ratios than heretofore achieved.

The extracting solvents and cosolvents employed in the present invention can be used in their commercially available forms as noted above or can be purified to remove any undesired components which might be present in the commercially available forms.

Step (3) of the process of this invention simply comprises recovery of the diesel oil upgraded as a result of the reaction step (1) and extraction step (2) of the process of this invention. Conventional procedures for removal of extracting solvent from a diesel oil can be employed. These extraction procedures include distillation, fractional crystallization, water washing followed by distillation and any other appropriate conventional procedures for removing an extracting solvent from an oil substrate. The process of this invention is not to be construed as limited in any way to selection of a specific diesel oil recovery and separation procedure. A particularly advantageous aspect of the process of this invention is that the cosolvent can be used as a means for recovery of the primary solvent, e.g., using conventional washing procedures.

It can be seen from an examination of the essential steps in the process of this invention that because of the mild reaction conditions employed in step (1) of the process of this invention, the simple control of the essential parameters which need to be controlled, the efficiency and selectivity of the extracting solvents employed, and the low pressure, low temperature and reduced complexity involved, the present invention results in a remarkably economical and advantageous process. This is particularly true when it is compared with the high temperature and high pressure hydrodesulfurization treatments employed conventionally in the past. Further, the advantages of the process of this invention can be seen in comparison with similar upgrading processing using catalysts conventionally employed in the art since an expensive catalyst is not needed and no steps are required to separate catalyst or regenerate catalyst. Thus, the process of this invention is considered to be a marked advance over current technology for cetane improvement and purification of diesel oils containing sulfur impurities or instability-causing impurities, and is believed to be of particular commercial significance.

As indicated above, in one embodiment the process of this invention can be used to purify and upgrade diesel fuel oil by increasing cetane number while retaining stability, reducing sulfur and reducing Ramsbottom carbon content. In general, diesel oil product from the first step of the present invention and having a sulfur content up to about 4% by weight, a stability as determined by the Nalco test of greater than about 20, an increased cetane number based on feed and a Ramsbottom carbon content of about 15% can be purified and upgraded according to the process of this invention to obtain a diesel fuel having a Nalco rating of 7 or less, a cetane number increase, in general on the order of about 5–20 based on the feed although this is representative, a Ramsbottom carbon content of less than about 2%, and on the order of about 5–70% sulfur impurity content removal.

In addition, the diesel oil upgraded in accordance with the process of this invention can be used as a blending stock to produce desired products, such as a diesel fuel having an improved cetane number. For example, the high-cetane, low-sulfur raffinate obtained in the process according to the invention can be blended with other diesel fuels or cycle oils which may have good stabilities but low cetane, or in some cases high sulfur, to obtain a diesel fuel meeting product specifications.

With respect to the product specification of stability a measured by the Nalco test, product stability is a particularly important attribute of blending stocks, since stability is not directly related to blend ratio. For example, blending equal amounts of one stock having a Nalco stability of 13 and another stock having a Nalco stability of 1 would not necessarily produce a blended fuel having an acceptable Nalco rating of 7. While it is desired to blend a cetane-enhanced diesel fuel with a low-cetane fuel to achieve produce specifications, this disparity in the resulting stability can result in an off-standard fuel with respect to stability. For this reason, the process of the present invention has particular application to blendstocks used to increase the cetane number of a blended fuel, since it is possible to produce a blendstock having a high cetane number without an unacceptably high Nalco rating, which can advantageously be used to increase the cetane rating of a blended fuel without encountering stability problems.

Further, the process of this invention in an additional embodiment advantageously provides the ability to conduct the steps indicated above followed by blending the upgraded diesel fuel product with other off-specification or on-specification diesel oils to produce a blended diesel fuel of superior properties of cetane, stability, Ramsbottom carbon and sulfur content. Still further, the off-specification diesel oil with which the upgraded product is blended may be a product from treating a diesel oil with a nitrogenous treating agent, in order to optimize properties of cetane, stability, Ramsbottom carbon, and sulfur content for a specific application.

Further, each of the embodiments of the process of this invention described above can be advantageously conducted in a batchwise, semi-continuous or continuous manner.

The following examples are given to illustrate the process of the present invention in greater detail. These specific examples are given for the purpose of exemplification, and are not to be construed as in any way limiting the process of the present invention. Unless otherwise indicated herein, all parts, percents, ratios and the like are by weight.

In the examples to follow, the reacting of the diesel oil with a nitrogenous treating agent consisting of a nitrogenous treating agent gas was conducted using a semi-batch reactor system consisting of a jacketed cylindrical vessel capable of accommodating a one-liter charge. The reactor was fitted with an impeller shaft terminating with a Teflon or stainless steel impeller. The reactor was further equipped with a thermometer, a sample withdrawal tube and a glass condenser. A gas inlet tube passing into the bottom of the reactor was used to introduce the treating gas through a sparger to the oil previously charged to the reactor.

In the examples to follow, the diesel oils used were atmospheric gas oils having the properties shown in Table 1 above.

The procedure employed for reacting the treating gas with the atmospheric gas oil was to charge about 3 liters of the oil into the reactor. The treating gas flow rate into the reactor was set by considering the weight ratio of treating agent to atmospheric gas oil and the contact time. The weight ratio set forth in the examples to follow is the ratio of total weight of treating agent used for a particular contact time to the total weight of the oil charge. Control of the flow rate was achieved using a rotameter, appropriately calibrated.

Various contact times for reaction of 5, 15, 30, 60 and 120 minutes, various weight ratios of treating agent to total diesel oil feed weight of 0.01 to 0.14 were employed at a reaction temperature of 5° C. unless otherwise indicated. When nitrogen dioxide was used as a treating agent, it was mixed with air at a volume ratio of one part nitrogen dioxide to four parts air.

In operation, when using a gaseous treating agent, after calculation of an appropriate rotameter setting, atmospheric gas oil was charged to the reactor, the reactor was heated to the prescribed temperature, the rotameter valve was opened to achieve appropriate treating gas flow into the reactor, and the timer was started. The reaction mixture was agitated by a stirrer. Temperature measurements were made at appropriate intervals and at the conclusion, flow of the treating gas was stopped and a sample of the treated diesel oil was obtained for analysis. The remainder of the oxidized oil was then employed in extraction.

The procedure employed for reacting the nitrogenous treating agent as a liquid with the atmospheric gas oil was to charge about 3 liters of the oil into the reactor. The treating liquid flow rate into the reactor was set by considering the weight ratio of nitrogenous treating agent to atmospheric gas oil and the contact time. The weight ratio set forth in the examples to follow is the ratio of total weight of liquid treating agent used for a particular contact time to the total weight of the oil charge. Control of the flow rate was achieved by a fine stop-cock on a buret, which contained the liquid.

Various contact times for reaction of 5, 15, 30, and 60 minutes, various weight ratios of treating agent to total diesel oil feed weight of 0.01 to 0.14 were employed at a reaction temperature of 25° C. unless otherwise stated. The concentration of nitrogenous treating agent liquid employed was 90%.

In operation, when using a liquid treating agent, atmospheric gas oil was charged to the reactor, the reactor was heated to the prescribed temperature, the flow of treating agent was initiated at the appropriate treating liquid flow into the reactor, and the timer was started. The reaction mixture was agitated by a stirrer. Temperature measurements were made at appropriate intervals and at the conclusion, flow of the treating liquid was stopped and a sample of the treated diesel oil was obtained for analysis. The remainder of the oxidized oil was then employed in extraction.

All solvent extractions performed were single-stage batch extractions except as noted. In the extraction set forth in the examples below, approximately 20 ml of oil was poured into a 60 ml separatory funnel. The primary solvent and cosolvent, if any, employed were then added to the oil in the separatory funnel in an appropriate ratio by weight to the oil. The separatory funnel was then shaken and allowed to stand from one to thirty minutes at room temperature to achieve complete separation. After the system was stabilized, an extract phase (containing solvents, sulfur-containing compounds, instability-causing compounds, nitrogen-containing compounds and cetane-inhibiting compounds) was collected and the yield of raffinate (oil plus minor amount of dissolved solvents) was determined. Also, after each extraction the raffinate was washed twice with water, using a water-to-raffinate ratio of 1.0 by weight for each wash, before measuring the raffinate oil yield. After washing, the final oil obtained (from which the solvents had been removed) was collected and weighed.

Sulfur analysis was conducted using a Princeton Gamma-Tech Model 100 chemical analyzer. Stability analysis was conducted by a standard Nalco test, i.e., by heating a tube containing the sample of oil at 300° F. for 90 minutes and then filtering the heated oil using a micropore filter and No. 1 filter paper, followed by washing the filter and the filter paper with heptane and comparing the residue to standards. The cetane number of the resulting diesel fuel was determined using a diesel test engine in accordance with ASTM procedures. Ramsbottom carbon content was evaluated by distilling 90% overhead and taking a portion of the bottom 10% which was burned in a Ramsbottom oven, after which the residue was weighed. Unless otherwise indicated, all parts, percents, ratios and the like are by weight.

EXAMPLE 1

A three liter sample of atmospheric gas oil (Stock X) was reacted at 5° C., and one atmosphere, using 200 $cm^3$/min $NO_2$ and 1 l/min air, for a contact time of 2 hours. The oxidized oil contained 0.82% S, and 5450 ppm N, and had a very poor stability with a Nalco rating of much greater than 20.

About 100 ml of this oxidized oil was extracted with either (a) a primary solvent as shown in Table 2 below or (b) a primary solvent plus a cosolvent as shown in Table 2 below, simultaneously. Each of the raffinates obtained from this extraction was water-washed twice at a water/oil ratio of 1.0 to remove retained solvent. The results obtained are shown in Table 2 below.

TABLE 2

| | Impact of Cosolvent Extraction on $NO_2$ Treated AGO (Stock X) | | | | | | |
|---|---|---|---|---|---|---|---|
| Primary Solvent | S/O | Cosolvent | S/O | Oil Yield (wt. %) | S in Oil (%) | N in Oil (ppm) | Nalco Stability of Oil |
| — | — | Methanol | 0.5 | 91.9 | 0.59 | 2520 | 17 |
| — | — | Methanol | 1.0 | 88.3 | 0.52 | 2320 | 12 |
| — | — | Ethanol | 0.5 | 92.1 | 0.62 | 3090 | 20 |
| — | — | Ethanol | 1.0 | 86.8 | 0.52 | 1970 | 17 |
| — | — | Propanol | 1.0 | mis | — | — | — |
| — | — | Butanol | 1.0 | mis | — | — | — |
| Butyrolactone | 0.5 | — | — | 88.0 | 0.43 | 1520 | 12 |
| " | 1.0 | — | — | 86.1 | 0.33 | 870 | 9 |
| " | 0.5 | Methanol | 0.5 | 84.9 | 0.36 | 1040 | 4 |
| " | 0.5 | Ethanol | 0.5 | 84.7 | 0.35 | 1380 | 7 |
| " | 0.5 | Propanol | 0.5 | 73.0 | 0.33 | 1270 | 11 |
| " | 0.5 | Butanol | 0.5 | 72.8 | 0.39 | 1640 | 10 |
| Furfural | 0.5 | — | — | 87.4 | 0.38 | 1440 | 13 |
| Furfural | 1.0 | — | — | 82.8 | 0.26 | 930 | 6 |
| Furfural | 0.5 | Methanol | 0.5 | 85.1 | 0.41 | 1775 | 11 |
| Furfural | 0.5 | Ethanol | 0.5 | 84.1 | 0.36 | 1500 | 12 |
| Furfural | 0.5 | Propanol | 0.5 | 67.1 | 0.39 | 1690 | 13 |
| Furfural | 0.5 | Butanol | 0.5 | 65.9 | 0.48 | 2340 | 9 |
| DMF | 0.5 | — | — | 85.3 | 0.33 | 1200 | 11 |
| DMF | 1.0 | — | — | 80.3 | 0.25 | 740 | 5 |
| DMF | 0.5 | Methanol | 0.5 | 81.7 | 0.35 | 1250 | 4 |

TABLE 2-continued

| Primary Solvent | S/O | Cosolvent | S/O | Oil Yield (wt. %) | S in Oil (%) | N in Oil (ppm) | Nalco Stability of Oil |
|---|---|---|---|---|---|---|---|
| | Impact of Cosolvent Extraction on $NO_2$ Treated AGO (Stock X) | | | | | | |
| DMF | 0.5 | Ethanol | 0.5 | 82.0 | 0.36 | 1400 | 5 |
| DMF | 0.5 | Propanol | 0.5 | 52.7 | 0.34 | 1410 | 11 |
| DMF | 0.5 | Butanol | 0.5 | mis | — | — | — |
| DMSO | 0.5 | — | — | 91.7 | 0.48 | 1870 | 14 |
| DMSO | 1.0 | — | — | 88.3 | 0.41 | 1270 | 8 |
| DMSO | 0.5 | Methanol | 0.5 | 86.9 | 0.40 | 1520 | 4 |
| DMSO | 0.5 | Ethanol | 0.5 | 87.2 | 0.41 | 1640 | 12 |
| DMSO | 0.5 | Propanol | 0.5 | 74.4 | 0.34 | 1270 | 8 |
| DMSO | 0.5 | Butanol | 0.5 | 68.2 | 0.30 | 1200 | 8 |
| 1-Methyl-2-pyrrolidinone | 0.5 | — | — | 82.3 | 0.34 | 1190 | 11 |
| " | 1.0 | — | — | 74.7 | 0.23 | 730 | 8 |
| " | 0.5 | Methanol | 0.5 | 78.1 | 0.32 | 1180 | 6 |
| " | 0.5 | Ethanol | 0.5 | 77.6 | 0.34 | 1450 | 7 |
| " | 0.5 | Propanol | 0.5 | mis | — | — | — |
| " | 0.5 | Butanol | 0.5 | mis | — | — | — |

DMF = dimethyl formamide; DMSO = dimethyl sulfoxide; mis = miscible; (hereinafter the same).

The stability of the oxidized oil after extraction at a solvent/oil ratio of 1.0 with butyrolactone (as a primary solvent) or by methanol (an example of a cosolvent as employed in the present invention but used alone) was 9 and 12, respectively. Both single stage extractions improve the stability of the oil. Simultaneous extraction of the oxidized oil using butyrolactone and methanol (solvent/oil ratio was 0.5 for each solvent), however, increased the stability to a rating of 4, which is much better than using either the above primary solvent or the above cosolvent alone. Hence, primary solvent with cosolvent extraction provides an unexpected improvement over single solvent extraction of treated diesel oil. It is apparent from considering the sulfur level of Stock X as shown in Table 1 above with the sulfur levels shown in Table 2 above that sulfur content is greatly reduced for diesel fuels processed by this invention.

EXAMPLE 2

A three liter sample of atmospheric gas oil (Stock X) was reacted at 25° C. and one atmosphere, using 150 grams of a 90% aqueous solution of $HNO_3$ for a contact time of 1 hour. The oxidized oil contained 0.80% S and 5700 ppm N, and had a Nalco stability of much greater than 20.

About 100 ml of the oxidized oil was extracted individually with (a) DMF, a primary solvent or with solvents described herein as cosolvents, or (b) a combination of DMF and one of the cosolvents. Each raffinate oil obtained was water-washed twice at a water/oil ratio of 1.0. The extraction results (i) with DMF alone as the primary solvent, (ii) with formaldehyde, acetaldehyde, methanol, or acetone alone as a cosolvent and (iii) with use of DMF as a primary solvent and a cosolvent together are shown in Table 3 below.

TABLE 3

| Primary Solvent | S/O | Cosolvent | S/O | Oil Yield (wt. %) | S in Oil (%) | N in Oil (ppm) | Nalco Stability of Oil |
|---|---|---|---|---|---|---|---|
| | Impact of Cosolvent Extraction on $HNO_3$ Treated AGO (Stock X) | | | | | | |
| DMF | 0.5 | — | — | 84.4 | 0.35 | 1112 | 19 |
| — | — | Formaldehyde (37%)* | 0.5 | 100.0 | 0.80 | 4704 | 20 |
| — | — | Acetaldehyde | 0.5 | 100.0 | 0.81 | 4753 | — |
| — | — | Formic Acid (90%) | 0.5 | 97.4 | 0.71 | 4308 | >20 |
| — | — | Acetic Acid | 0.5 | 90.1 | 0.59 | 3067 | >20 |
| — | — | Propanic Acid | 0.5 | mis | — | — | — |
| — | — | Butanoic Acid | 0.5 | mis | — | — | — |
| DMF | 0.5 | Formaldehyde (37%) | 0.5 | 97.6 | 0.73 | 4113 | 20 |
| DMF | 0.5 | Methanol | 0.5 | 81.8 | 0.41 | — | 14 |
| DMF | 0.5 | Acetaldehyde | 0.5 | 78.1 | 0.31 | 953 | 7 |
| DMF | 0.5 | Acetone | 0.5 | 76.8 | 0.29 | 940 | 13 |
| DMF** | 0.5 | Formic Acid (90%) | 0.5 | 80.3 | 0.35 | 1407 | 10 |
| DMF** | 0.5 | Acetic Acid | 0.5 | 79.2 | 0.25 | 751 | 8 |
| Origin of Treated Diesel Oil: 0.5 A/O Ratio at 25° C. 0.80% S, 5700 ppm N, and >>20 for Nalco stability. | | | | | | | |

*The figures in ( ) indicate the percentage by weight of an aqueous solution, herein the same.
**Sequential extraction.

The results indicate that the stability of the product is improved when a cosolvent is used in admixture with the primary solvent. The results also indicate that some materials designated as cosolvents herein (e.g., formic acid and acetic acid) can also be very effective in improving the stability if they are used in sequence with the primary solvent.

Extraction results with DMF as the primary solvent and some higher molecular weight aldehydes, ketones and carboxylic acids as cosolvents are shown in Table 4 below. Some of these cosolvents are miscible with the treated oil upon extraction. However, when mixed with the primary solvent, they result in a phase separation between raffinate and extract phase.

TABLE 4

Impact of Cosolvent Extraction on $HNO_3$ Treated AGO (Stock X) (Comparative Cosolvents)

| Primary Solvent | S/O | Cosolvent | S/O | Oil Yield (wt. %) | S in Oil (%) | N in Oil (ppm) | Nalco Stability of Oil |
|---|---|---|---|---|---|---|---|
| — | — | Propionaldehyde | 0.5 | mis | — | — | — |
| — | — | Iso-butyraldehyde | 0.5 | mis | — | — | — |
| — | — | Hexanal | 0.5 | mis | — | — | — |
| — | — | Acetone | 0.5 | mis | — | — | — |
| — | — | 2-Butanone | 0.5 | mis | — | — | — |
| — | — | 3-Pentanone | 0.5 | mis | — | — | — |
| — | — | 2-Octanone | 0.5 | mis | — | — | — |
| DMF | 0.5 | Propionaldehyde | 0.5 | 73.7 | 0.37 | 1209 | 20 |
| DMF | 0.5 | Iso-butyraldehyde | 0.5 | 66.1 | 0.37 | 1909 | 18 |
| DMF | 0.5 | Hexanal | 0.5 | mis | — | — | — |
| DMF | 0.5 | 2-Butanone | 0.5 | mis | — | — | — |
| DMF | 0.5 | 3-Pentanone | 0.5 | mis | — | — | — |
| DMF | 0.5 | 2-Octanone | 0.5 | mis | — | — | — |
| DMF | 0.5 | Formic Acid (90%) | 0.5 | 924.0 | 0.55 | 2532 | 20 |
| DMF | 0.5 | Acetic Acid (<98%) | 0.5 | 86.2 | 0.39 | 1635 | 18 |

Origin of Treated Diesel Oil: 0.5 A/O Ratio at 25° C.
0.80% S, 5700 ppm N, and >>20 for Nalco stability.

The results in Table 4 above indicate that the stability of oil is not improved greatly using these higher molecular weight cosolvents. As to the combinations of DMF and formic acid and DMF and acetic acid, the results indicate due to the presence of water in these acids, a higher solvent-to-oil ratio should be used.

EXAMPLE 3

A three liter sample of atmospheric gas oil (Stock CC) was reacted at 25° C., and one atmosphere using 28 g of a 90% aqueous solution of $HNO_3$ for a contact time of 30 minutes. The oxidized oil contained 0.69% S and 1700 ppm N, 5.0% RBC and had a Nalco stability of much greater than 20.

This oxidized oil was extracted at 25° C. in a continuous column (0.75 inch I.D., 24 inches high, and 180 ml volume) with a primary solvent as shown in Table 5 below. The total throughput was 0.2 gph with the oxidized oil as the continuous phase. The extracted oil was further extracted batchwise with a cosolvent for reduction of sulfur content, stability and Ramsbottom carbon. The results are shown in Table 5 below.

TABLE 5

Impact of Cosolvent Extraction on $HNO_3$ Treated AGO (Stock CC) Continuous Extraction for Primary Solvents Extraction

| Primary Solvent | S/O | Cosolvent | S/O | Oil Yield (wt. %) | S in Oil (%) | Nalco Stability of Oil | RBC (%) |
|---|---|---|---|---|---|---|---|
| Furfural | 0.86 | — | — | 90.3 | 0.29 | 9 | 0.15 |
| Furfural | 0.86 | Methanol | 0.2 | 92.9 | 0.28 | 4 | 0.14 |

Origin of Treated Diesel Oil: 0.01 A/O Ratio at 25° C.
0.69% S, 1700 ppm N, and >>20 for Nalco stability, 5.0% RBC.

It is clear that cosolvent extraction further improves the stability of the raffinate (a decrease from 9 to 4). It can be seen that the efficiency of extraction is better in continuous mode than in batch mode. Thus, the solvent-/oil ratio can be routinely adjusted to obtain optimum performance.

EXAMPLE 4

A sample of the oxidized oil produced as described in Example 3 was used for extraction with a primary solvent followed by a cosolvent, at 25° C. and one atmosphere. Another advantage of using a cosolvent in sequence to the primary solvent in the process of this invention is the removal of small amounts of high boiling primary solvent from the raffinate. The results obtained are shown in Table 6 below.

TABLE 6

Removal of Trace Levels of Primary Solvent In Oil From Cosolvent Extraction (Stock CC)

| Primary Solvent | S/O | Cosolvent | S/O | Concentration of Primary Solvent in Oil (%) Before CoSolvent Extraction | After CoSolvent Extraction |
|---|---|---|---|---|---|
| DMF (90%)* | 0.24 | Methanol | 0.2 | 3.92 | 0 |
| DMF (90%)* | 0.76 | Methanol | 0.2 | 4.20 | 0 |
| Furfural | 0.30 | Methanol | 0.1 | 1.80 | 0 |
| Furfural | 0.40 | Methanol | 0.2 | 1.70 | 0.11 |
| Furfural | 0.50 | Methanol | 0.2 | 1.93 | 0.7 |
| Furfural | 0.5 | Methanol | 0.4 | 1.50 | 0 |

*Primary solvent extraction was performed in a continuous extraction mode.

Depending on the solvent/oil ratio used in the primary solvent extraction, the solvent/oil ratio for cosolvent extraction can be adjusted to remove substantially all the primary solvent from the raffinite oil. The primary solvent can be recovered from the cosolvent extract phase by conventional separation processes.

While the invention has been described in detail with respect to specific embodiments thereof, it will be apparent to one skilled in the art that modifications and changes can be made therein without departing from the spirit and scope thereof.

What is claimed is:

1. A process for upgrading diesel oil comprising the steps of:

(1) reacting the diesel oil with a nitrogenous treating agent;

(2) contacting the diesel oil from step (1) above with (a) a primary solvent selected from the group consisting of organic solvents having a dipole moment of about 1.3 or greater and mixtures thereof, with the proviso that alkyl amines and alkanol amines are excluded, or a water mixture of the primary solvent comprising about 50% by weight or less water and;

(b) a cosolvent different from the primary solvent selected from the group consisting of an alcohol having 1 to 4 carbon atoms, an aldehyde having 1 or 2 carbon atoms, a ketone having 3 carbon atoms, a carboxylic acid having 1 or 2 carbon atoms and mixtures thereof, or a water mixture of the cosolvent comprising about 50% by weight or less water;

wherein the primary solvent and the cosolvent are each immiscible with the diesel oil or are in combination immiscible with the diesel oil, and (3) separating the diesel oil from step (2) above from the primary solvent and from the cosolvent to recover upgraded diesel fuel with inproved cetane number.

2. The process of claim 1, wherein said nitrogenous treating agent is selected from the group consisting of (1) a gas comprising at least one nitrogen oxide with more than one oxygen atom for each nitrogen atom, (2) a liquid comprising at least one nitrogen oxide with more than one oxygen atom for each nitrogen atom, (3) a liquid comprising nitric acid containing from about 0 to 90% by weight water and (4) a liquid comprising nitrous acid containing from about 0 to about 90% by weight water.

3. The process of claim 1, wherein said contacting step (1) is conducted in the presence of at least one acid selected from the group consisting of organic acids, inorganic acids and mixtures thereof.

4. The process of claim 3, wherein said organic acid is selected from the group consisting of acetic acid and formic acid, and said inorganic acid is elected from the group consisting of sulfuric acid and phosphoric acid.

5. The process of claim 3, wherein said organic acid is present in an amount of from about 0.01 to about 0.15 parts by weight, and said inorganic acid is present in an amount of from about 0.002 to 0.15 parts by weight per weight part of said diesal oil.

6. The process of claim 1, wherein said nitrogenous treating agent is a gaseous or liquid nitrogenous oxide treating agent and such is present in a weight ratio of from about 0.0001 to about 0.5 to said diesel oil.

7. The process of claim 1, wherein said nitrogenous treating agent is nitric acid or nitrous acid and such is present in a weight ratio of from about 0.0002 to about 0.5 to said diesel oil.

8. The process of claim 6, wherein said nitrogenous treating agent is a gaseous or liquid nitrogenous oxide treating agent and such is present in a weight ratio of from about 0.0003 to about 0.06 to said diesel oil.

9. The process of claim 7, wherein said nitrogenous treating agent is nitric acid or nitrous acid and such is present in a weight ratio of from about 0.0005 to about 0.1 to said diesel oil.

10. The process of claim 1, wherein the weight ratio of said primary solvent to said diesel oil is from about 0.01:1 to about 5:1 and the weight ratio of said cosolvent to said diesel oil is from about 0.01 to about 5:1.

11. The process of claim 1, wherein the weight ratio of said primary solvent to said diesel oil is from about 0.1:1 to about 0.5:1 and the weight ratio of said cosolvent to said diesel oil is from about 0.1:1 to about 0.5:1.

12. The process of claim 1, wherein said primary solvent and said cosolvent are both simultaneously contacted with said diesel oil.

13. The process of claim 1, wherein said primary solvent is first contacted with said diesel oil and, after extraction with the primary solvent, said cosolvent is contacted with the diesel oil.

14. The process of claim 1, wherein said primary solvent is furfural or a water mixture thereof comprising about 50% by weight or less water.

15. The process of claim 1, wherein said primary solvent is gamma-butyrolactone or a water mixture thereof comprising about 50% by weight or less water.

16. The process of claim 1, wherein said primary solvent is dimethyl formamide or a water mixture thereof comprising about 50% by weight or less water.

17. The process of claim 1, wherein said primary solvent is dimethyl acetamide or a water mixture thereof comprising about 50% by weight or less water.

18. The process of claim 1, wherein said primary solvent is methyl carbitol or a water mixture thereof comprising about 50% by weight or less water.

19. The process of claim 1, wherein said primary solvent is tetrahydrofurfuryl alcohol or a water mixture thereof comprising about 50% by weight or less water.

20. The process of claim 1, wherein said primary solvent is aniline or a water mixture thereof comprising about 50% by weight or less water.

21. The process of claim 1, wherein said primary solvent is dimethyl sulfoxide or a water mixture thereof comprising about 50% by weight or less water.

22. The process of claim 1, wherein said primary solvent is sulfolane or a water mixture thereof comprising about 50% by weight or less water.

23. The process of claim 1, wherein said primary solvent is ethylene chlorohydrin or a water mixture thereof comprising about 50% by weight or less water.

24. The process of claim 1, wherein said primary solvent is acetic anhydride or a water mixture thereof comprising about 50% by weight or less water.

25. The process of claim 1, wherein said primary solvent is phenol or a water mixture thereof comprising about 50% by weight or less water.

26. The process of claim 1, wherein said primary solvent is nitromethane or a water mixture thereof comprising about 50% by weight or less water.

27. The process of claim 1, wherein said primary solvent is N-methyl pyrrolidone or a water mixture thereof comprising about 50% by weight or less water.

28. The process of claim 1, wherein said primary solvent is sulfolene or a water mixture thereof comprising about 50% by weight or less water.

29. The process of claim 1, wherein said primary solvent is methanol or a water mixture thereof comprising about 50% by weight or less water.

30. The process of claim 1, wherein said primary solvent is acetonitrile or a water mixture thereof comprising about 50% by weight or less water.

31. The process of claim 1, wherein said primary solvent is ethyl cyanoacetate or a water mixture thereof comprising about 50% by weight or less water.

32. The process of claim 1, wherein said primary solvent is acetic acid or a water mixture thereof comprising about 50% by weight or less water.

33. The process of claim 1, wherein said cosolvent is an alcohol selected from the group consisting of methanol, ethanol, propanol, and butanol.

34. The process of claim 33, wherein said alcohol is methanol.

35. The process of claim 34, wherein said methanol is present in a weight ratio of from about 0.01 to about 5 to said diesel oil.

36. The process of claim 35, wherein said methanol is present in a weight ratio of from about 0.1 to about 0.5 to said diesel oil.

37. The process of claim 1, wherein said cosolvent is an aldehyde.

38. The process of claim 37, wherein said aldehyde is acetaldehyde.

39. The process of claim 38, wherein said acetaldehyde is present in a weight ratio of from about 0.01 to about 5 to said diesel oil.

40. The process of claim 39, wherein said acetaldehyde is present in a weight ratio of from about 0.1 to 0.5 to said oil.

41. The process of claim 1, wherein said cosolvent is acetone.

42. The process of claim 41, wherein said acetone is present in a weight ratio of from about 0.01 to about 5 to said diesel oil.

43. The process of claim 42, wherein said acetone is present in a weight ratio of from about 0.1 to about 0.5 to said diesel oil.

44. The process of claim 1, wherein said cosolvent is acetic acid.

45. The process of claim 44, wherein said acetic acid is present in a weight ratio of from about 0.01 to about 5 to said diesel oil.

46. The process of claim 45, wherein said acetic acid is present in a weight ratio of from about 0.1 to about 0.5 to said diesel oil.

47. The process of claim 1, wherein said process additionally comprises (4) blending the upgraded diesel fuel of step (3) with a diesel fuel which does not meet industrial specifications as to cetane number, sulfur content, Ramsbottom carbon, product stability and/or pour point, in an amount to produce a diesel fuel meeting said specifications.

48. A process for upgrading diesel oil comprising the steps of:

(1) reacting the diesel oil with a nitrogenous treating agent;

(2) contacting the diesel oil from step (1) above with (a) a primary solvent selected from the group consisting of organic solvents having a dipole moment of about 1.3 or greater and containing at least one of the following functional groups:

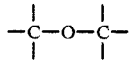

-continued

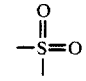

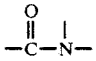

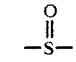

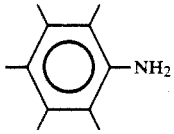

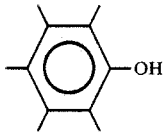

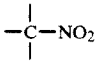

and

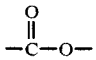

and mixtures thereof or a water mixture of the primary solvent comprising about 50% by weight or less water; and (b) a cosolvent different from the primary solvent selected from the group consisting of an alcohol having 1 to 4 carbon atoms, an aldehyde having 1 to 2 carbon atoms, a ketone having 3 carbon atoms, a carboxylic acid having 1 or 2 carbon atoms, and mixtures thereof, or a water mixture of the cosolvent comprising about 50% by weight or less water;

wherein the primary solvent and the cosolvent are each immiscible with the diesel oil or are in combination immiscible with the diesel oil, and (3) separating the diesel oil from step (2) above from the primary solvent and from the cosolvent to recover upgraded diesel fuel with improved cetane number.

49. The process of claim 48, wherein said nitrogenous treating agent is selected from the group consisting of (1) a gas comprising at least one nitrogen oxide with more than one oxygen atom for each nitrogen atom, (2) a liquid comprising at least one nitrogen oxide with more than one oxygen atom for each nitrogen atom, (3) a liquid comprising nitric acid containing from about 0 to 90% by weight water and (4) a liquid comprising nitrous acid containing from about 0 to about 90% by weight water.

50. The process of claim 48, wherein said contacting step (1) is conducted in the presence of at least one acid selected from the group consisting of organic acids, inorganic acids and mixtures thereof.

51. The process of claim 48, wherein said organic acid is selected from the group consisting of acetic acid and formic acid, and said inorganic acid is elected from the group consisting of sulfuric acid and phosphoric acid.

52. The process of claim 48, wherein said organic acid is present in an amount of from about 0.01 to about 0.15 parts by weight, and said inorganic acid is present in an amount of from about 0.002 to 0.15 parts by weight per weight part of said diesel oil.

53. The process of claim 48, wherein said nitrogenous treating agent is a gaseous or liquid nitrogenous oxide treating agent and such is present in a weight ratio of from about 0.0001 to about 0.5 to said diesel oil.

54. The process of claim 48, wherein said nitrogenous treating agent is nitric acid or nitrous acid and such is present in a weight ratio of from about 0.0002 to about 0.5 to said diesel oil.

55. The process of claim 48, wherein said nitrogenous treating agent is a gaseous or liquid nitrogenous oxide treating agent and such is present in a weight ratio of about 0.0003 to about 0.06 to said diesel oil.

56. The process of claim 54, wherein said nitrogenous treating agent is a gaseous or liquid nitrogenous treating agent and such is present in a weight ratio of about 0.0005 to about 0.1 to said diesel oil.

57. The process of claim 48, wherein the weight ratio of said primary solvent to said diesel oil is from about 0.01 to about 5:1 and the weight ratio of said cosolvent to said diesel oil is from about 0.01 to about 5:1.

58. The process of claim 55, wherein the weight ratio of said primary solvent to said diesel oil is from about 0.1:1 to about 0.5:1 and the weight ratio of said cosolvent to said diesel oil is from about 0.1:1 to about 0.5:1.

59. The process of claim 48, wherein said primary solvent and said cosolvent are both simultaneously contacted with said diesel oil.

60. The process of claim 48, wherein said primary solvent is first contacted with said diesel oil and, after extraction with the primary solvent, said cosolvent is contacted with the diesel oil.

61. The process of claim 48, wherein said cosolvent is an alcohol selected from the group consisting of methanol, ethanol, propanol, and butanol.

62. The process of claim 61, wherein said alcohol is methanol.

63. The process of claim 62, wherein said methanol is present in a weight ratio of from about 0.01 to about 5 to said diesel oil.

64. The process of claim 63, wherein said methanol is present in a weight ratio of from about 0.1 to about 0.5 to said diesel oil.

65. The process of claim 48, wherein said cosolvent is an aldehyde.

66. The process of claim 65, wherein said aldehyde is acetaldehyde.

67. The process of claim 66, wherein said acetaldehyde is present in a weight ratio of from about 0.01 to about 5 to said diesel oil.

68. The process of claim 67, wherein said acetaldehyde is present in a weight ratio of from about 0.1 to about 0.5 weight percent based on the weight of said diesel oil.

69. The process of claim 48, wherein said cosolvent is acetone.

70. The process of claim 69, wherein said acetone is present in a weight ratio of from about 0.01 to about 5 to said diesel oil.

71. The process of claim 70, wherein said acetone is present in a weight ratio of from about 0.1 to about 0.5 to said diesel oil.

72. The process of claim 48, wherein said cosolvent is acetic acid.

73. The process of claim 72, wherein said acetic acid is present in a weight ratio of from about 0.01 to about 5 to said diesel oil.

74. The process of claim 73, wherein said acetic acid is present in a weight ratio of from about 0.1 to about 0.5 to said diesel oil.

75. The process of claim 48, wherein said process additionally comprises (4) blending the upgraded diesel fuel of step (3) with a diesel fuel, which does not meet industrial specifications as to cetane number, sulfur content, Ramsbottom carbon, product stability and/or pour point, in an amount to produce a diesel fuel meeting said specifications.

76. A process for upgrading diesel oil comprising the steps of:

(1) reacting the diesel oil with a nitrogenous treating agent;

(2) contacting the diesel oil from step (1) above with (a) a primary solvent selected from the group consisting of furfural, butyrolactone, dimethyl formamide, dimethyl acetamide, methyl carbitol, tetrahydrofurfuryl alcohol, aniline, dimethyl sulfoxide, sulfolane, ethylene chlorohydrin, acetic anhydride, phenol, nitromethane, N-methylpyrrolidone, sulfolene, methanol, acetonitrile, ethyl cyanoacetate, acetic acid and mixtures thereof, or a water mixture of the primary solvent comprising about 50% by weight or less water, and (b) a cosolvent different from the primary solvent selected from the group consisting of an alcohol having 1 to 4 carbon atoms, an aldehyde having 1 or 2 carbon atoms, a ketone having 3 carbon atoms, a carboxylic acid having 1 or 2 carbon atoms, and mixtures thereof, or a water mixture of the cosolvent comprising about 50% by weight or less water;

wherein the primary solvent and the cosolvent are each immiscible with the diesel oil or are in combination immisible with the diesel oil, and (3) separating the diesel oil from step (2) above from the primary solvent and from the cosolvent to recover upgraded diesel fuel with improved cetane number.

77. The process of claim 76, wherein said nitrogenous treating agent is selected from the group consisting of (1) a gas comprising at least one nitrogen oxide with more than one oxygen atom for each nitrogen atom, (2) a liquid comprising at least one nitrogen oxide with more than one oxygen atom for each nitrogen atom, (3) a liquid comprising nitric acid containing from about 0 to 90% by weight water and (4) a liquid comprising nitrous acid containing from about 0 to about 90% by weight water.

78. The process of claim 76, wherein said contacting step (1) is conducted in the presence of at least one acid selected from the group consisting of organic acids, inorganic acids and mixtures thereof.

79. The process of claim 78, wherein said organic acid is selected from the group consisting of acetic acid and formic acid, and said inorganic acid is elected from the group consisting of sulfuric acid and phosphoric acid.

80. The process of claim 78, wherein said organic acid is present in an amount of from about 0.01 to about 0.15 parts by weight, and said inorganic acid is present in an amount of from about 0.002 to 0.15 parts by weight per weight part of said diesel oil.

81. The process of claim 76, wherein said nitrogenous treating agent is a gaseous or liquid nitrogenous oxide treating agent and such is present in a weight ratio of from about 0.0001 to about 0.5 to said diesel oil.

82. The process of claim 76, wherein said nitrogenous treating agent is nitric acid or nitrous acid and such is present in a weight ratio of from about 0.0002 to about 0.5 to said diesel oil.

83. The process of claim 76, wherein said nitrogenous treating agent is a gaseous or liquid nitrogenous oxide treating agent and such is present in a weight ratio of from about 0.0003 to about 0.06 to said diesel oil.

84. The process of claim 78, wherein said nitrogenous treating agent is nitric acid or nitrous acid and such is present in a weight ratio of from about 0.0005 to about 0.1 to said diesel oil.

85. The process of claim 76, wherein the weight ratio of said primary solvent to said diesel oil is from about 0.01 to about 5:1 and the weight ratio of said cosolvent to said diesel oil is from about 0.01 to about 5:1.

86. The process of claim 85, wherein the weight ratio of said primary solvent to said diesel oil is from about 0.1:1 to about 0.5:1 and the weight ratio of said cosolvent to said diesel oil is from about 0.1:1 to about 0.5:1.

87. The process of claim 76, wherein said primary solvent and said cosolvent are both simultaneously contacted with said diesel oil.

88. The process of claim 76, wherein said primary solvent is first contacted with said diesel oil and, after extraction with the primary solvent, said cosolvent is contacted with said diesel oil.

89. The process of claim 76, wherein said cosolvent is an alcohol selected from the group consisting of methanol, ethanol, propanol, and butanol.

90. The process of claim 89, wherein said alcohol is methanol.

91. The process of claim 90, wherein said methanol is present in a weight ratio of from about 0.01 to about 5 to said diesel oil.

92. The process of claim 91, wherein said methanol is present in a weight ratio of from about 0.1 to about 0.5 to said diesel oil.

93. The process of claim 76, wherein said cosolvent is acetaldehyde.

94. The process of claim 93, wherein said acetaldehyde present in a weight ratio of from about 0.01 to about 5 to said diesel oil.

95. The process of claim 94, wherein said acetaldehyde is present in a weight ratio of from about 0.1 to about 0.5 to said diesel oil.

96. The process of claim 76, wherein said cosolvent is acetone.

97. The process of claim 96, wherein said acetone is present in a weight ratio of from about 0.01 to about 5 to said diesel oil.

98. The process of claim 97, wherein said acetone is present in a weight ratio of from about 0.1 to about 0.5 to said diesel oil.

99. The process of claim 76, wherein said process additionally comprises (4) blending the upgraded diesel fuel of step (3) with a diesel fuel, which does not meet industrial specifications as to cetane number, sulfur content, Ramsbottom carbon, product stability and/or pour point, in an amount to produce a diesel fuel meeting said specifications.

* * * * *